United States Patent [19]

Osteen et al.

[11] Patent Number: 4,866,582

[45] Date of Patent: Sep. 12, 1989

[54] LUMINARES HAVING FLEXIBLE LIGHT SHIELDS

[75] Inventors: Mitchell M. Osteen, Zirconia; Warren Halper, Hendersonville, both of N.C.

[73] Assignee: General Electric Company, Schenectady, N.Y.

[21] Appl. No.: 209,157

[22] Filed: Jun. 20, 1988

[51] Int. Cl.[4] ..... F21V 11/00

[52] U.S. Cl. ..... 362/359; 362/278; 362/320; 362/431

[58] Field of Search ..... 362/278, 320, 344, 457, 362/359, 376, 431

[56] References Cited

U.S. PATENT DOCUMENTS

| | | | |
|---|---|---|---|
| 1,399,564 | 12/1921 | Kurre | 362/320 |
| 3,922,031 | 11/1975 | Hugon | 362/359 X |
| 4,160,286 | 7/1979 | Merritt | 362/457 X |
| 4,654,768 | 3/1987 | Dryman et al. | 362/374 |

*Primary Examiner*—Stephen F. Husar

*Attorney, Agent, or Firm*—John P. McMahon; Stanley C. Corwin; Fred Jacob

[57] ABSTRACT

Luminaires, floodlights and spotlights having a light shield comprised of a flexible material are disclosed. The flexible light shield has a slit in its majority and presents a low wind loading factor when used for a high mast luminaire that is subjected to wind speeds from 60 to 100 miles per hour typically experienced in storms or hurricanes. The flexible light shield is readily adapted to meet the light distribution needs of various other lighting units.

10 Claims, 4 Drawing Sheets

Fig. 2(a)
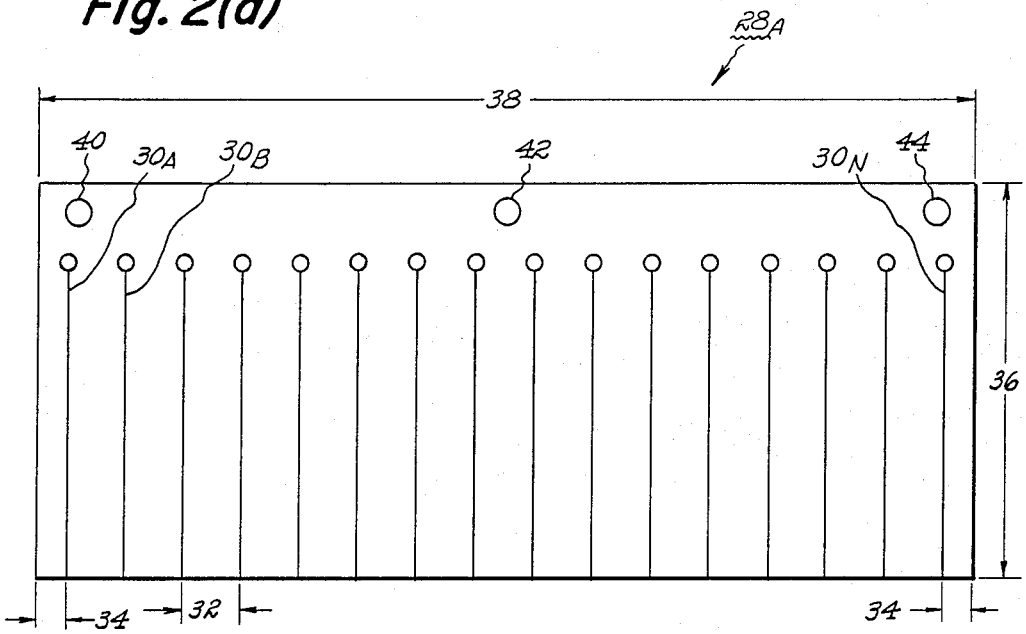
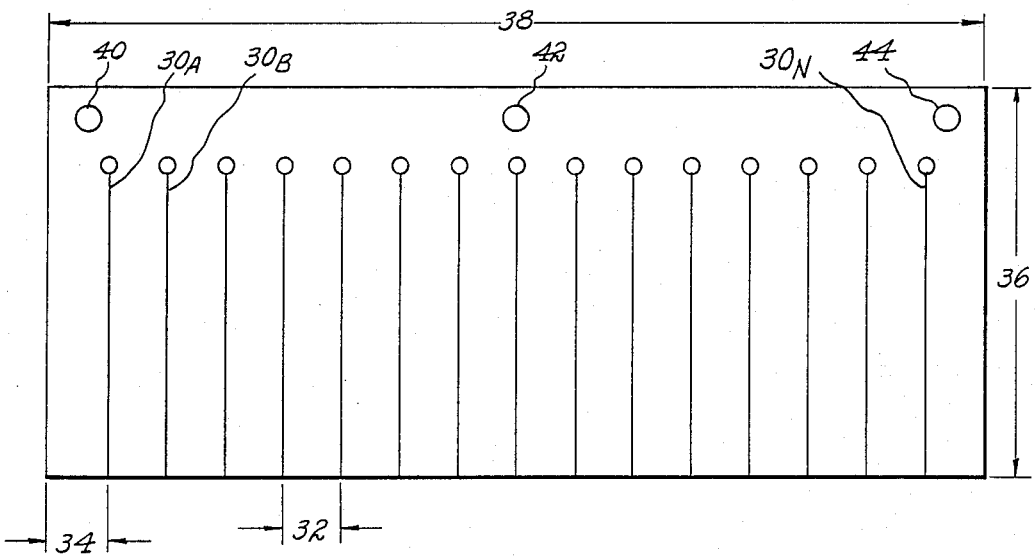
Fig. 2(b)

LUMINARES HAVING FLEXIBLE LIGHT SHIELDS

BACKGROUND OF THE INVENTION

This invention relates to luminaires, and more particularly, to luminaires having a light shield comprised of a flexible material.

Luminaires and also floodlights commonly have a light shield mounted on their periphery which restricts the light from being transmitted from the luminaires and floodlights in a particular direction. Such restriction for one situation may be desired to prevent transmitted light from entering and creating a hinderance to a residence. In order that this function may be provided, it is desired that the light shield extend below the luminaire or out from a floodlight by a sufficient amount to confine the transmitted light distribution to a desired ground area not encompassing the residence of concern. For such confinement it is sometimes necessary for the light shield to extend below the luminaire or out from a floodlight by an amount that may add significantly to the wind loading of the luminaire or floodlight. While these light shields provide for the desired confinement of light, these shields also present certain problems for particular luminaires such as those finding usage in high mast applications.

The relatively long light shields present a wind loading problem which is particularly acute when the high mast luminaires are subjected to high winds such as between 60 to 100 miles per hour typically experienced in storms or hurricanes. The wind loading caused by these relatively long light shields creates an undesirable situation in that the long shields create a relatively high wind loading factor which, in turn, creates an undesired or unsafe stress condition for the structural members mounting the luminaire above the roadway. It is desired that a relatively long light shield be provided that does not present an unsafe wind loading factor to the related high mast luminaire.

In addition to the high mast luminaire consideration, it is desired that the light shield be easily nd quickly adapted to various light distribution situations. For example, it is desired that for one situation a light shield may have a desired first contour and a needed length of about eight (8) inches while for another situation the desired contour may be different and the needed length may be four (4) inches. The actual length and contour may not be known until a person at the site of the luminaires so determines. It is desired that one light shield be provided that is able to be customized, on-site, to fit the various light distributions desired for the related luminaires. Further, it is desired that the light shield be easily adaptable to floodlights and spotlights.

Accordingly, it is an object of the present invention to provide a light shield that is readily adapted to meet the needs of various desired light distributions for the luminaires and other lighting units.

It is another object of the present invention to provide a relatively long light shield that presents a low wind loading factor to the related high mast luminaire.

SUMMARY OF THE INVENTION

The present invention is directed to a flexible light shield for a high mast luminaire that presents a low wind loading factor to the luminaire and in addition is easily adapted to meet the needs of the desired light distributions of lighting units.

The luminaire comprises an upper housing assembly for a light source, a reflector and a flexible light shield which extends therefrom.

DESCRIPTION OF THE DRAWING

FIGS. 2(*a*) and 2(*b*) illustrate the light shield of the present invention.

DETAILED DESCRIPTION OF THE PREFERRED EMBODIMENTS

Figure 1:
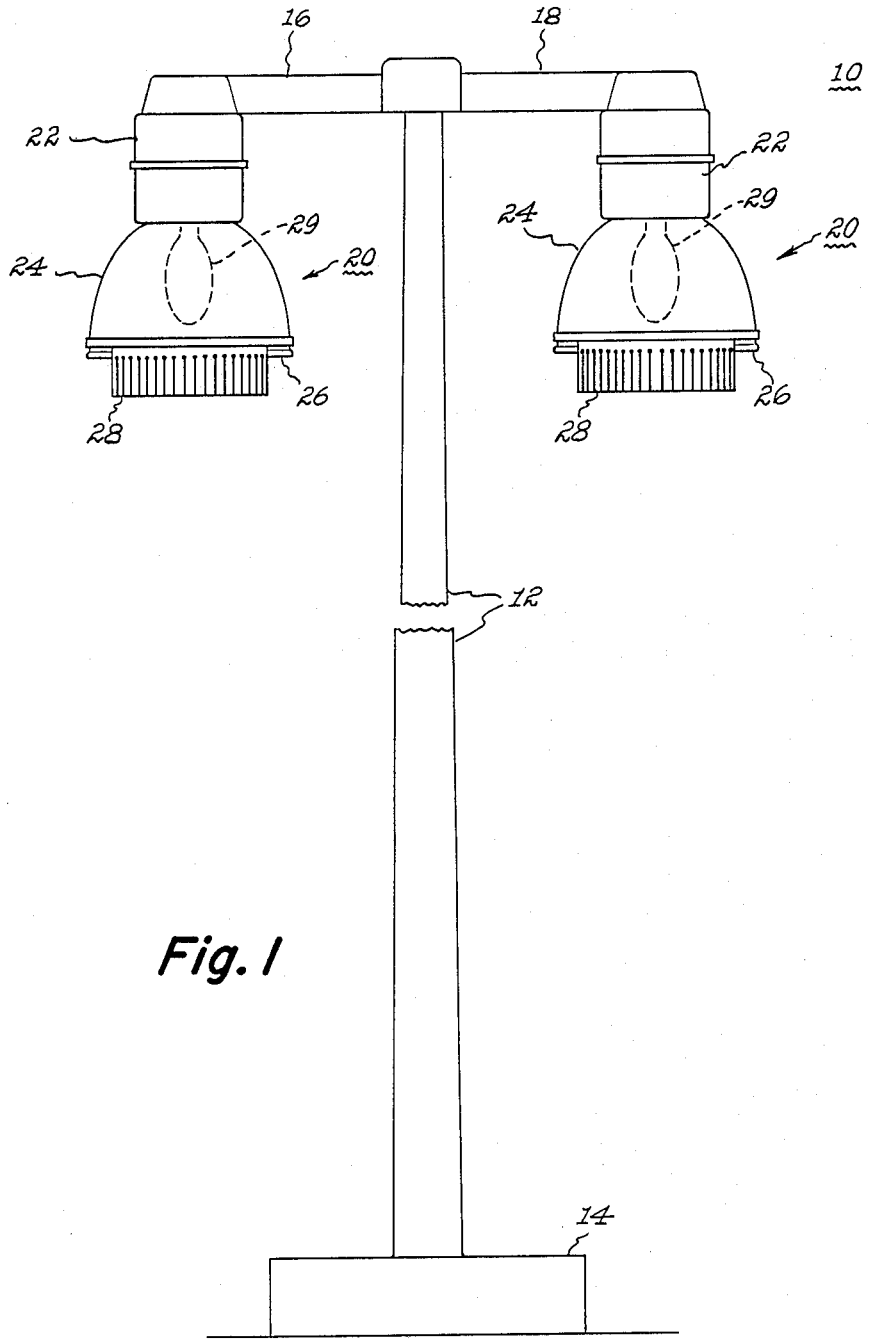
FIG. 1 is an illustration of a high mast luminaire having the benefits of the present invention.

Referring now to the drawing, and more particularly the FIG. 1, there is shown an high mast arrangement 10, in accordance with one embodiment of the present invention, comprising a mounting pole 12 with a typical length of 100–150 feet and having its bottom end embedded in a stabilizing member 14. The upper end of the pole 12 is connected to one or more extensions shown with reference numbers 16 and 18 with each extension being connected to a related luminaire 20. In various high mast applications, the number of extensions may total ten (10) to twelve (12) extensions with a typical number being six (6) and with each extension connected to a related luminaire 20. While FIG. 1 illustrates the luminaire 20 as being applicable to a high mast environment, the practice of this invention is equally applicable to other types of luminaires or floodlights such as that to be described with regard to FIG. 6.

Each luminaire 20 has an upper housing assembly 22 for connecting to the related extension member, a preferably polished aluminum reflector 24 and a flexible light shield 28 extending downward therefrom by a predetermined amount. The luminaire 20 may have its bottom portion opened or it may be closed by means of a lens or refractor 26 having means for attaching to the reflector 24. Each of the upper housings 22 of the related luminaire have means for accommodating a high intensity discharge lamp 29, shown in phantom, and ordinarily being a metal halide, mercury or a high pressure sodium vapor lamp. The refractor 26 of the related luminaire is preferably a substantially flat member which is preferably formed of glass but may be formed of a transparent high impact plastic or other light transmissive material.

As discussed in the "Background" section, the light shields such as light shield 28 performs a desired function of preventing light, which is generated by the luminaire 20, from being transmitted in the direction from where the light shields are mounted. Prior art light shields are typically formed of a rigid aluminum material and have a considered safety limit with regard to their extension below the refractor 26 for high mast applications. This limitation is about four inches when taken into account with the wind loading factor related to high mast luminaire applications that these rigid light shields create during wind speeds of 60 to 100 miles per hour which are typically experienced in storms or hurricanes. The wind loading factor presented by the prior art light shields having extending lengths of greater than four (4) inches create stress conditions which must be considered. For example, wind loading testing in the presence of an 80 mph condition was performed on an unshielded luminaire and it exhibited a drag of 23 pounds, and then this laminaire was fitted with a four inch light shield and the drag increased to 37 pounds. It is estimated that if the luminaire with a rigid nine inch light shield was tested, the drag would be about 104 pounds.

The flexible light shields 28 of the present invention do not have the disadvantage of the rigid light shields and may be described with reference to FIGS. 2(*a*) and 2(*b*). Light shield 28 may comprise two embodiments shown respectively in FIGS. 2(*a*) and 2(*b*) as $\mathbf{28}_A$ and $\mathbf{28}_B$ and aligned relative to each other. Each of the shields $\mathbf{28}_A$ and $\mathbf{28}_B$ comprises a flexible sheet formed of a suitable flexible material such as selected from the group consisting of stainless steel, polycarbonate, polypropylene, polyethylene and nylon. Other materials may also be used in the practice of this invention as long as the selected material accommodates the necessary bending of shields $\mathbf{28}_A$ and $\mathbf{28}_B$ in the presence of wind conditions in a manner to be described hereinafter. The light shields $\mathbf{28}_A$ and $\mathbf{28}_B$ have at least one slit extending throughout the majority of their vertical length and preferably having a cutout of about 0.18 inches located in their upper portion. More particularly, the light shields $\mathbf{28}_A$ and $\mathbf{28}_B$ each have columns of the slits $\mathbf{30}_A$, $\mathbf{30}_B$ . . . and $\mathbf{30}_N$ separated from each other by a predetermined amount 32 having a typical value in the range of about 0.5 to 5.0 inches with a preferred value of 1.0 inches. The slits $\mathbf{30}_A$, $\mathbf{30}_B$ . . . and $\mathbf{30}_N$ may have a width in the range of about 0.001 to about 0.032. The slits $\mathbf{30}_A$ and $\mathbf{30}_N$ of FIG. 2(*a*) are separated from the respective edges of the sheet by an amount 34 having a typical value in the range from about 0.25 to 5.0 inches with a preferred amount of about 0.5 inches, whereas, the slits $\mathbf{30}_A$ and $\mathbf{30}_N$ of FIG. 2(*b*) are separated from the respective edges by the amount 34 having a typical value in the range from about 0.25 to 5.0 inches with a preferred amount of about 1.0 inches.

The light shields $\mathbf{28}_A$ and $\mathbf{28}_B$ each have a typical vertical length 36 of about 12 inches, a horizontal length 38 with a typical value of about 20 inches, and a thickness in the range of about 0.001 to about 0.05 inches. These vertical and horizontal lengths along with the thickness vary in accordance with the dimensions of the luminaire, spotlight and floodlight for which the light shields $\mathbf{28}_A$ and $\mathbf{28}_B$ find application. The upper portion of the shields $\mathbf{28}_A$ and $\mathbf{28}_B$ each have locating holes 40, 42 and 44 having a diameter of about 0.221 inches which, in one embodiment, allows for mating with a clamp band assembly that attaches the reflector 24.

Each of the shields $\mathbf{28}_A$ and $\mathbf{28}_B$ are constructed of the flexible material having the described slits that permits the shield to advantageously function in accordance with the wind conditions to which the shields are subjected. Under relatively calm wind conditions, the shields maintain a substantial erect, non-bent condition. If the wind conditions increase, the shields begin to bend and thereby do not present any substantial wind loading factor that may cause an undesired or unsafe stress condition for the extension members 16 and 18 shown in FIG. 1 supporting the luminaires 20. It is especially desired that the light shields of the present invention bend in the presence of wind conditions of between 60 to 100 mph typically occurring during storms and hurricanes. The flexible light shields eliminate the need for improving the structural capabilities of the extension members that may otherwise be necessary to accommodate the needed light confinements for the previous situations discussed in the "Background" section.

The flexible shields $\mathbf{28}_A$ and $\mathbf{28}_B$ while providing a desired light distribution for the luminaires in which they are employed do suffer a disadvantage in that when subjected to a sufficient wind condition, the slits bend and allow light to be transmitted through the slits in an unwanted direction. The flexible shields $\mathbf{28}_A$ and $\mathbf{28}_B$ may be arranged in a cooperative manner to avoid this problem such as that which may be further described with reference to FIG. 3.

Figure 3:
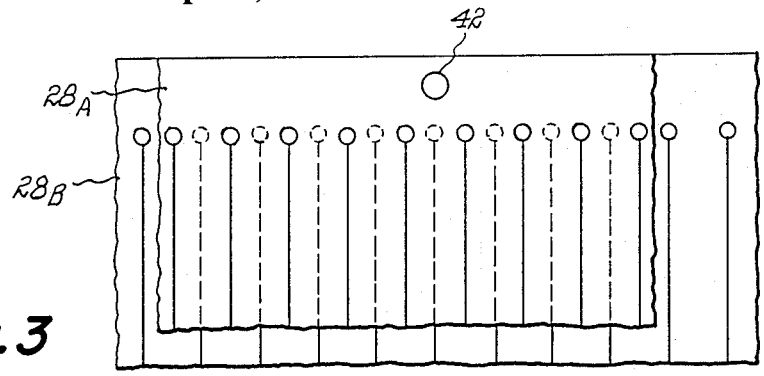
FIG. 3 shows an arrangement of the light shields of FIGS. 2(*a*) and 2(*b*) in accordance with one embodiment of the present invention.

FIG. 3 shows light shield $\mathbf{28}_B$ as placed over light shield $\mathbf{28}_A$ so that the slits of light shield $\mathbf{28}_A$, shown in phantom, are offset relative to those of the light shield $\mathbf{28}_B$. The offset arrangement provides a path to block and thereby prevent the light from being transmitted through composite shields formed by layers $\mathbf{28}_A$ and $\mathbf{28}_B$. This offset arrangement eliminates most, if not all, of the light generated from the luminaire that may possibly leak out through the slits. The combination of shields $\mathbf{28}_A$ and $\mathbf{28}_B$ bends in the wind in a manner as previously described for the operation of a single light shield. These flexible light shields capable of bending in the wind without taking any significant permanent set toward the deflective angle, may also be provided to reflect or absorb any particular wavelengths of the light emitted by the light source 29 so as to enhance the light distribution of the luminaire 20.

The light shield 28 of the present invention due to its flexible nature of its material, may easily be adapted to the light distributors desired for various applications. For example, as discussed in the "Background" section it may be desired to have a light shield extend downward from the refractor or lens by eight (8) inches and at a particular contour for one situation, and then for another situation extend downward from the refractor or lens by ten (10) inches at a different contour. Such variable lengths and contours are easily accomplished by cutting the flexible light shield to its desired length and contour. Further, this desired length and contour may be determined during the operative condition of the luminaire 20 while the light shield is cut with appropriate tools so as to prevent the light from being transmitted into the residence of concern but allowing the remaining light to be distributed to the desired surface area under consideration. The light shields are preferably arranged relative to the refractor 26 and may be described with reference to FIG. 4.

Figure 4:
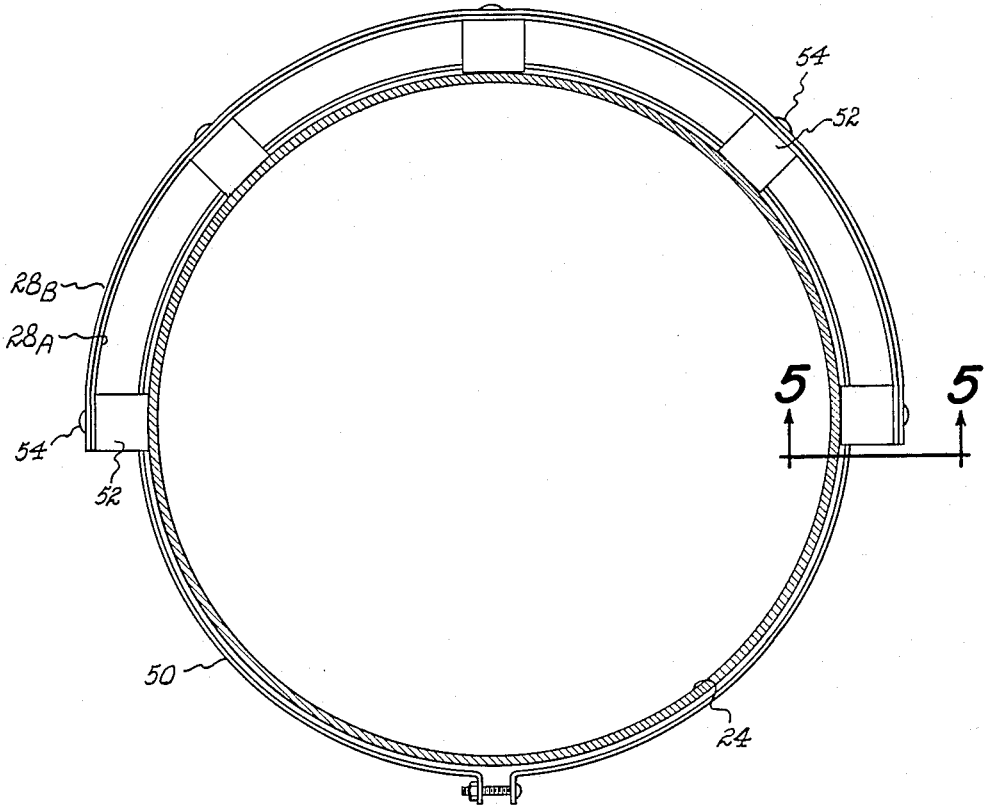
FIG. 4 illustrates the placement of the light shields relative to the reflector of the related luminaire.

FIG. 4 shows an arrangement comprised of a clamp band 50 which is attached to the reflector 24 and has circumferentially spaced around its periphery the light shields $\mathbf{28}_A$ and $\mathbf{28}_B$. For the embodiment shown in FIG. 4, the light shields $\mathbf{28}_A$ and $\mathbf{28}_B$ are arranged to cover about 180° of the periphery of the reflector 24 thereas to prevent light from being transmitted therefrom. The light shields $\mathbf{28}_A$ and $\mathbf{28}_B$ may be arranged to cover from 0° to 360° of the periphery to fit the needs of the illumination distribution desired. Similarly, light shield $\mathbf{28}_A$ or $\mathbf{28}_B$ may be singularly arranged to cover the periphery in a desired manner.

Figure 5:
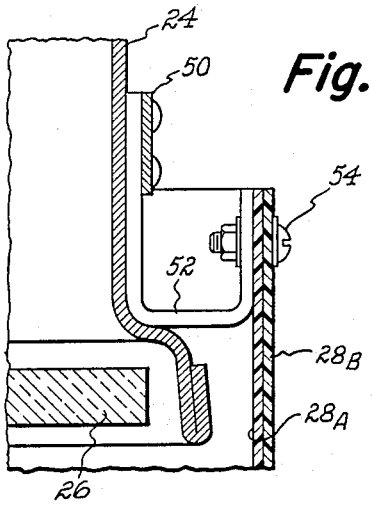
FIG. 5 is a sectional view showing the attachment relationship of a light shield to the reflector.

For one embodiment, the means for mounting the shields $\mathbf{28}_A$ and $\mathbf{28}_B$ to the reflector 24 and relative to the refractor 26 may be described with reference to FIG. 5. FIG. 5 is a partial sectional view showing the shields $28_A$ and $28_B$ attached to a bracket 52 by means a nut and bolt arrangement 54. The bracket 52 is fitted between the reflector 24 and the clamp band 50.

Figure 6:
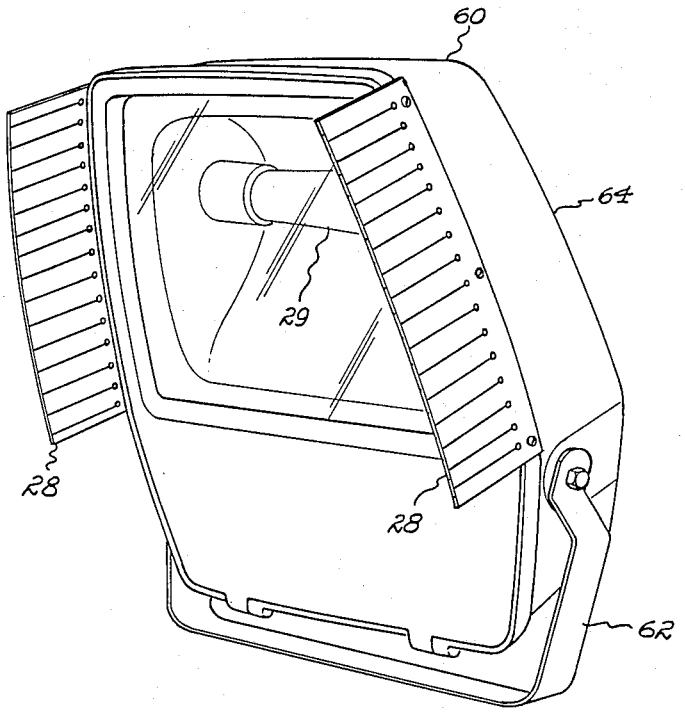
FIG. 6 is an illustration of a lighting unit having the light shields of the present invention attached thereto.

In another embodiment related to floodlights and spotlights the light shield 28 may be placed on the side as generally illustrated in FIG. 6. FIG. 6 shows a lighting unit 60 that is aimed downward by about 45° from the horizontal by adjusting means 62. The lighting unit has a main housing 64 for accommodating the light source 29 and side shields 28. The side shields 28 of unit 60 function in a manner as previously discussed for luminaire 20 to confine the light emitted by light source 29 to be confined into a desired illumination pattern.

It should now be appreciated that the practice of the present invention provides for a light shield that is mounted to a luminaire, spotlight or floodlight and is comprised of a flexible material that allows it to bend in the wind and not to present any substantial wind loading factor which is of particular importance to high mast luminaires.

What we claim as new and desire to secure by Letters Patent Of the United States is:

1. A light shield for luminaires and spotlights comprising a flexible sheet having at least one slit in a majority of its vertical length, said flexible sheet having means so as to be attachable to said luminaires and spotlights, said light shield bending when attached thereto and subjected to relatively high wind conditions.

2. A light shield according to claim 1 wherein said sheet is formed of a material selected from the group consisting of stainless steel, polycarbonate, polypropylene, polyethylene and nylon.

3. A light shield according to claim 1 wherein said sheet has columns of said slits separated from each other by a predetermined amount.

4. A light shield according to claim 2 wherein said columns of slits are separated by each other by an amount in the range of about 0.25 inches to about 5.0 inches.

5. A luminaire comprising;

(a) an upper housing assembly accommodating a light source, (b) a reflector, and (c) a first flexible light shield connected to said reflector and extending downward by a predetermined amount from said reflector, said light shield having at least one slit in a majority of its vertical length, said flexible light shield bending when subjected to relatively high wind conditions.

6. A luminaire according to claim 5 further comprising a second flexible light shield having slits which are offset from said at least one slit by a predetermined amount.

7. A luminaire according to claim 5 further comprising a refractor enclosing the bottom of said reflector.

8. A luminaire according to claim 5 further comprising a lens enclosing the bottom of said reflector.

9. A lighting unit comprising;

(a) a housing accommodating a light source, and (b) a first flexible light shield connected to said housing and extending outward therefrom by a predetermined amount, said flexible light shield having at least one slit in a majority of the predetermined amount extending outward from said housing, said flexible light shield bending when subjected to relatively high wind conditions.

10. A lighting unit according to claim 9 further comprising a second flexible light shield having slits which are offset from said at least one slit by a predetermined amount.

* * * * *